United States Patent [19]

Hopkins et al.

[11] Patent Number: 4,900,041

[45] Date of Patent: Feb. 13, 1990

[54] SUBSEA WELL CASING HANGER PACKOFF SYSTEM

[75] Inventors: Bob C. Hopkins, Nassau Bay; Randy J. Wester, Spring, both of Tex.; Don C. Underwood, Rio de Janeiro, Brazil

[73] Assignee: FMC Corporation, Chicago, Ill.

[21] Appl. No.: 283,047

[22] Filed: Dec. 6, 1988

Related U.S. Application Data

[63] Continuation of Ser. No. 186,993, Apr. 27, 1988, abandoned.

[51] Int. Cl.[4] ..... F16J 15/08; F21B 33/04

[52] U.S. Cl. ..... 277/30; 277/116.2; 277/117; 277/205; 277/236; 166/115; 166/209; 166/217

[58] Field of Search ..... 166/115, 206, 208, 209, 166/217, 382, 387; 285/917; 277/30, 31, 116.2, 117–122, 138, 190, 191, 205, 236, 212 C, 206 R, 235 B

[56] References Cited

U.S. PATENT DOCUMENTS

| | | | |
|---|---|---|---|
| 881,060 | 3/1908 | Cook | 285/917 X |
| 2,144,682 | 1/1939 | MacClatchie | 277/31 |
| 2,451,888 | 10/1948 | Thompson | 277/205 X |
| 3,414,276 | 12/1968 | Faccou et al. | 277/206 R X |
| 3,561,776 | 2/1971 | Wilson | 277/212 C X |
| 4,103,909 | 8/1978 | Hoffman et al. | 277/116.2 X |
| 4,372,563 | 2/1983 | Diehl et al. | 277/117 |
| 4,410,189 | 10/1983 | Myers et al. | 277/117 |
| 4,480,703 | 11/1984 | Garrett | 277/31 X |
| 4,595,053 | 6/1986 | Watkins et al. | 166/209 |
| 4,655,979 | 5/1987 | Boehm, Jr. | 277/236 X |

FOREIGN PATENT DOCUMENTS

| | | | |
|---|---|---|---|
| 578688 | 6/1959 | Canada | 277/205 |
| 2237067 | 2/1974 | Fed. Rep. of Germany | 277/235 B |
| 1231867 | 4/1959 | France | 277/205 |
| 206792 | 11/1939 | Switzerland | 277/138 |
| 1383319 | 2/1975 | United Kingdom | 277/235 B |

*Primary Examiner*—William A. Cuchlinski, Jr.
*Assistant Examiner*—Scott W. Cummings
*Attorney, Agent, or Firm*—W. W. Ritt, Jr.; R. B. Megley

[57] ABSTRACT

An improved metal-to-metal seal packoff system for establishing a high pressure metallic barrier between concentric tubular elements, such as a wellhead housing and a casing hanger, including a seal element with a pair of annular metal sealing lips that are energized by the wedging force of an expander mandrel having a cross-sectional configuration resembling a tuning fork with depending legs.

8 Claims, 4 Drawing Sheets

SUBSEA WELL CASING HANGER PACKOFF SYSTEM

This application is a continuation of application Ser. No. 07/186,993, filed 04/27/88, now abondoned.

This invention relates to packoff systems for pressure sealing the annulus between adjacent concentric tubular elements, such as a wellhead housing and a casing hanger in a subsea well, and more particularly to such packoff systems that provide a metal-to-metal seal between the elements.

BACKGROUND OF THE INVENTION

In the oil and gas industry, and especially in subsea or other underwater well drilling procedures, it is well established practice to employe an annular seal assembly, referred to as a packoff, between adjacent concentric wellhead elements, such as the wellhead housing and the casing hangers that support the casing strings in the well, to pressure seal the annuli between these elements. For many years these packoffs have included elastomeric or other non-metallic annular seal elements that, when energized into tight contact with the opposed wellhead and hanger surfaces, provided the requisite pressure barrier. However, the growing trend towards drilling deep wells into relatively high pressure strata, and the frequency encountering in these wells of hydrogen sulfide or other corrosive gases, has led to the development of packoffs with all metal seal elements to establish a metal-to-metal pressure barrier. Although some of the known packoffs with metal-to-metal seals function satisfactorily under certain conditions, there is a growing industry need for such packoffs that can be installed from a remote location without difficulty, that will withstand higher operating pressures than heretofore experienced, and tht will maintain the seal throughout wide fluctuations in pressure.

SUMMARY OF THE INVENTION

Broadly considered, the present invention comprises an improved metal-to-metal seal packoff system for establishing a high pressure metallic barrier between adjacent surfaces of concentric tubular elements, and especially for sealing the annulus between a wellhead housing and a casing hanger located concentrically therein, and for maintaining the metal pressure barrier or seal throughout relatively extreme pressure variations. The packoffs of this invention comprise assemblies of parts, including uniquely configured metal seal elements and seal energizers therefor, that cooperate in a novel manner to produce a significantly improved seal with considerably enhanced ability to withstand unusually high fluctuations in well pressures, that are relatively easy to assemble, and that are capable of installation as an assembled unit into a subsea or other remotely located wellhead without complicated procedures or other detrimental problems.

Each of the below described and illustrated embodiments of a metal-to-metal packoff according to this invention comprises a seal element with a pair of annular metal sealing lips that are energized, i.e. expanded, into pressure-tight contact with opposed annular metal surfaces of, for example, a wellhead housing and an inner casing hanger by the wedging force of an annular expander mandrel that has a cross-sectional configuration resembling that of a tuning fork with depending legs. The legs, actually annular axial flanges, of the mandrel are radially compressed during that wedging-type seal energization action to result in production of bending energy in the legs as well as in the lips of the seal element, which energy maintains the seal lips in pressure-tight engagement with the opposed wellhead and hanger surfaces throughout wide variations in well pressures to which the seal element may be exposed. Each of the described packoff seal embodiments is locked in a retracted, unenergized position while it is being run or otherwise placed in proper position in the wellhead, and activation to expand the metal seal lips into energized contact with the opposed surfaces of the wellhead and hanger cannot occur until purposefully performed by the operator through use of a packoff running tool.

The metal-to-metal seals established by the packoffs of the invention are designed to be backed up by annular elastomeric seals to provide a second sealing function which is desireable under certain circumstances, and when so equipped the secondary elastomeric seal elements preferably are slightly larger in diameter to provide a degree of protection of the metal seal lips during installation and other handling. Thus in tight-fitting locations the elastomeric seal elements can provide a primary or secondary seal between the wellhead and hanger independent of the seal provided by the metal seal element.

DESCRIPTION OF THE PREFERRED EMBODIMENT

Figure 1:
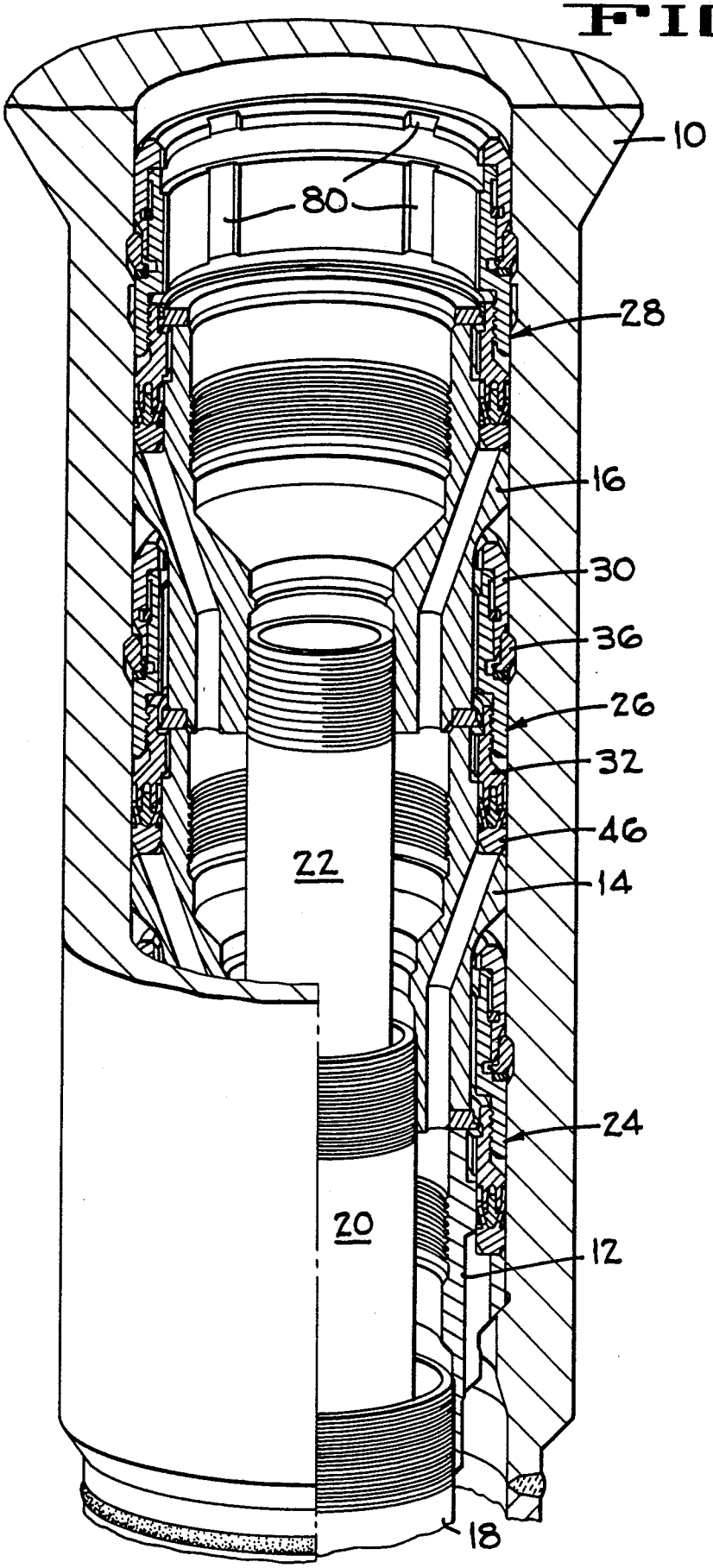
FIG. 1 is an isometric view of a subsea wellhead housing surrounding the upper ends of three concentric strings of well casing, with the right half and upper portion of the left half of the drawing in vertical central section to show the packoff assemblies of the present invention installed between the housing and the casing hangers.

FIG. 1 illustrates a typical subsea wellhead system for suspending three casing strings at the seafloor, the system generally comprising an outer wellhead housing 10, first, second and third casing hangers 12, 14 and 16 for supporting outer, intermediate and inner casing strings 18, 20 and 22, respectively, in the housing 10, and first, second and third identical packoff assemblies 24, 26 and 28 for pressure sealing the annuli between the housing 10 and the hangers 12, 14 and 16, respectively. As seen best in FIGS. 3 and 4, each of the annular packoff assemblies comprises a two-piece body having upper and lower components 30, 32 rotatably interconnected by threads 34, a lock ring 36 surrounding and carried by the upper body component 30, an annular lock ring expander mandrel 38 also surrounding the upper body component 30 and retained on it above the lock ring by a snap ring 40, that resides partially in an inner groove 42 in the mandrel and around an outer cylindrical surface 44 of the upper body 30, and an annular metal seal element 46 secured to the lower end of the lower body component 32 by a plurality of circumferentially spaced stud and nut retainers 48 (only one shown). Each of the packoff assemblies further includes an anti-rotation ring 47 releasably secured to the upper body component 30 by a plurality of circumferentially spaced shear pins 49 (only one shown) to prevent relative rotation between the upper and lower body components 30, 32 until the packoff assembly is properly positioned and ready for energizing between the housing 10 and the hanger 14.

Figure 2:
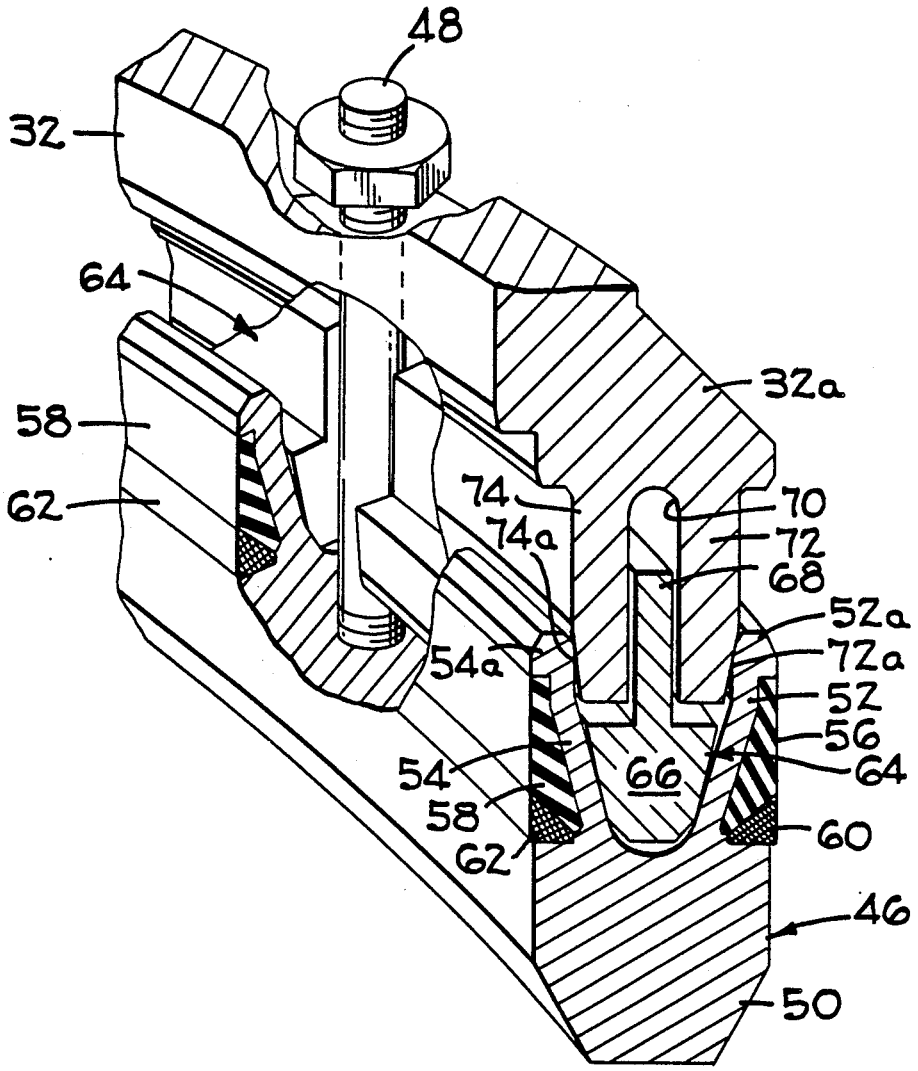
FIG. 2 is an enlarged fragmentary isometric view in vertical section of one of the packoff assemblies of FIG. 1.
Figure 3:
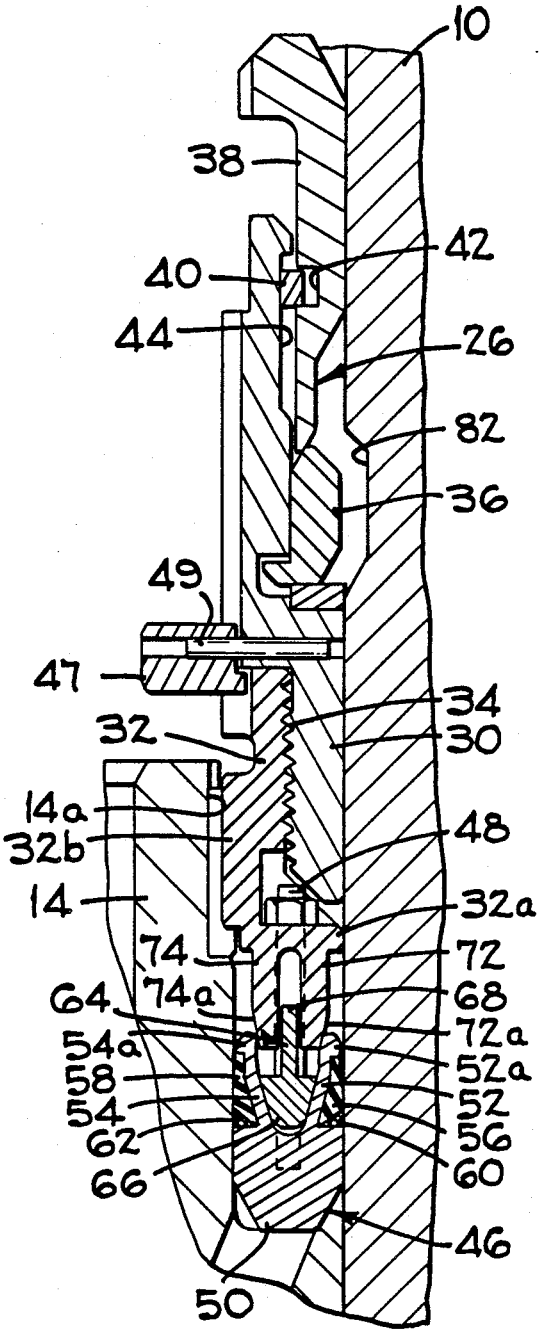
FIG. 3 is an enlarged fragmentary view in vertical section showing the packoff assembly of FIGS. 1 and 2 in landed position between the wellhead housing and the adjacent casing hanger, but prior to setting it into functional metal-to-metal sealing condition.

As shown best in FIG. 2, but also shown in FIGS. 3. and 4, the preferred embodiment of the packoff's seal element 46 comprises an annular metal base portion 50 and a pair of annular metal sealing lips 52, 54 that extend upwardly in a relatively diverging or V-shaped manner from the base 50, a pair of annular elastomeric seals 56, 58 surrounding the outer surfaces of the sealing lips 52, 54, respectively, and a pair of annular wire-mesh or other suitable type of anti-extrusion rings 60,62. The seal element 46 further includes a plurality of segmented spacers 64 having a somewhat tall, slender inverted mushroom shape in cross-sectional configuration, the spacers arranged circumferentially between the retainer studs 48. Each spacer 64 comprises a lower tapered base portion or head 66 that, in the assembled condition shown in the drawings, resides between the seal lips 52, 54, and a central web portion 68 that extends upwardly from the head 66 into a central annular space 70 defined by a pair of annular legs 72, 74 extending downwardly from the lower end portion 32*a* of the packoff lower body 32.

Figure 4:
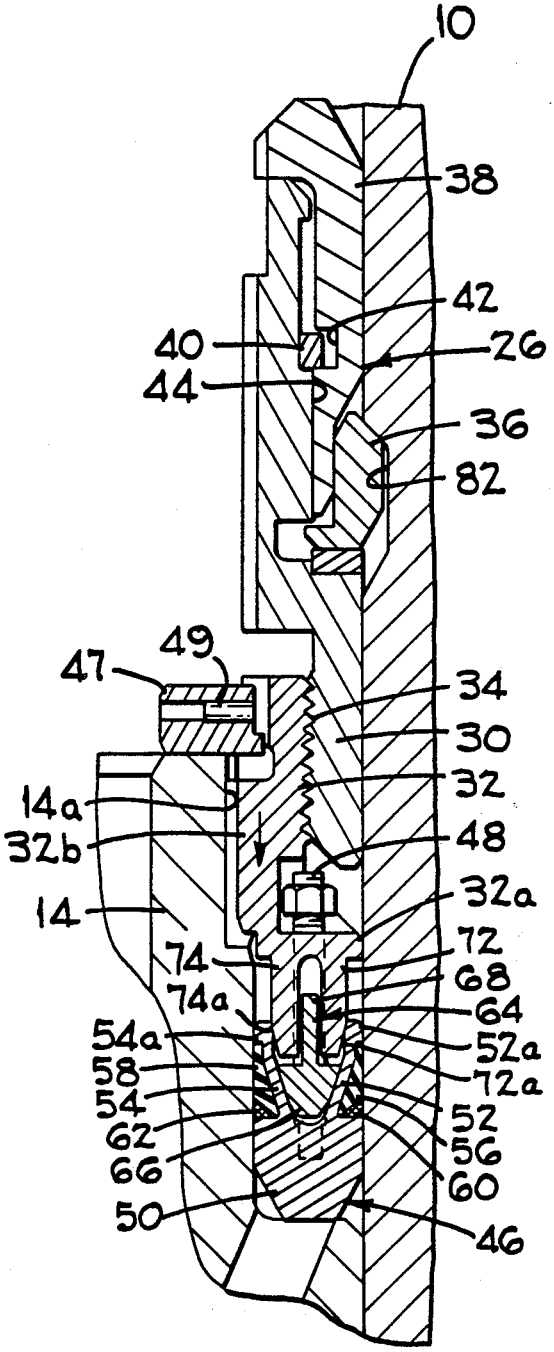
FIG. 4 is a view like FIG. 3, showing the packoff set in its metal-to-metal sealing condition.

The annular legs 72, 74 of the packoff lower body 32 are dimensioned to fit tightly between the upper end portions 52*a*, 54*a* of the seal element sealing lips 52, 54 as seen in FIGS. 2–4, and their lower outer surfaces are tapered or contoured at 72*a*, 74*a* to establish a wedge-like relationship with these lips. Thus as the packoff lower body 32 is forced downwardly from its position shown in FIG. 3 into its FIG. 4 position by rotation of the upper body 30 during the setting procedure, the seal lips 52, 54 are mechanically wedged (spread) apart into pressure tight, metal-to-metal contact with the adjacent surfaces of the housing 10 and the hanger 14. During this seal lip spreading operation bending energy is imparted to the seal lips which functions to maintain them in positive, metal-to-metal contact with the wellhead and hanger over a wide range of well pressures and fluctuations thereof. The annular legs 72, 74 also incur some bending energy during this operation, and the webs 68 of the spacers 64 prevent these legs from experiencing excessive permanent deformation when the well annulus pressure below the packoff pushes up on the seal element from the bottom. The legs 72, 74 will not, however, permanently yield due to loading but will retain some bending energy when subsequent low operating pressures are encountered, thereby maintaining intact the metal-to-metal seal between the hanger and wellhead housing.

INSTALLATION OF THE PACKOFF ASSEMBLY

Each packoff assembly 24, 26, 28 is installed in the wellhead housing 10 by means of a running tool (not shown) attached to the lower end of a pipe string (not shown) that are controlled and manipulated from the surface drilling platform (not shown), a procedure generally well known in the industry. Referring to FIGS. 3 and 4 for illustrative purposes, once the casing hanger 14 has been lowered into position in the housing 10 and its casing string 20 has been cemented in place, the packoff assembly 26 is lowered on the running tool and landed on the hanger as shown in FIG. 3. In this position the packoff lower body 32 is locked against rotation by the cooperative action of an axial groove 14*a* in the upper outer surface of the hanger 14 and a mating axial rib 32*b* on the adjacent inner surface of the body 32. Should the rib 32*b* not be in proper alignment with the groove 14*a* as the packoff is being lowered, the running tool is rotated by rotation of the running string until the alignment is achieved and the landing step can continue.

The running tool is then rotated to the right, shearing pins (not shown) that releasably secure it to the packoff. As this rotation occurs the tool aligns with vertical slots 80 (FIG. 1) in the packoff and drops further into it, forcing the expander mandrel 38 down behind the lock ring 36 which, in response, expands fully into its wellhead housing groove 82, and causing the packoff anti-rotation ring 47 to shear the pins 49 and drop onto the upper end of the casing hanger 14 (FIG. 4) which thereby frees the packoff's upper body 30 to rotate.

The running tool is then further rotated to the right, causing corresponding right-hand rotation of the packoff's upper body 30. As this occurs the threads 34 between the upper body 30 and the lower body 32 cause these bodies to move in axial opposite directions, resulting in establishing a compressive force contained between the lock ring 36 and the casing hanger 14. This compressive force actuates the packoff seal element 46 to effect the desired metal-to-metal sealing engagement with the wellhead housing 10 and the hanger 14. Low torque is sufficient to achieve this seal element actuation, a highly desireable advantage with packoff assemblies of the present invention.

REMOVAL OF THE PACKOFF ASSEMBLY

The packoff assemblies of this invention can be removed from their set position in the wellhead housing 10 (FIG. 4) by lifting the expander mandrel 38 from behind the lock ring 36, allowing the ring to contract out of the housing groove 82 into its FIG. 3 position against the upper body surface. This releases the packoff from the housing, and frees it for withdrawal by merely lifting it vertically.

THE EMBODIMENTS OF FIGS. 5–7

Figure 5:
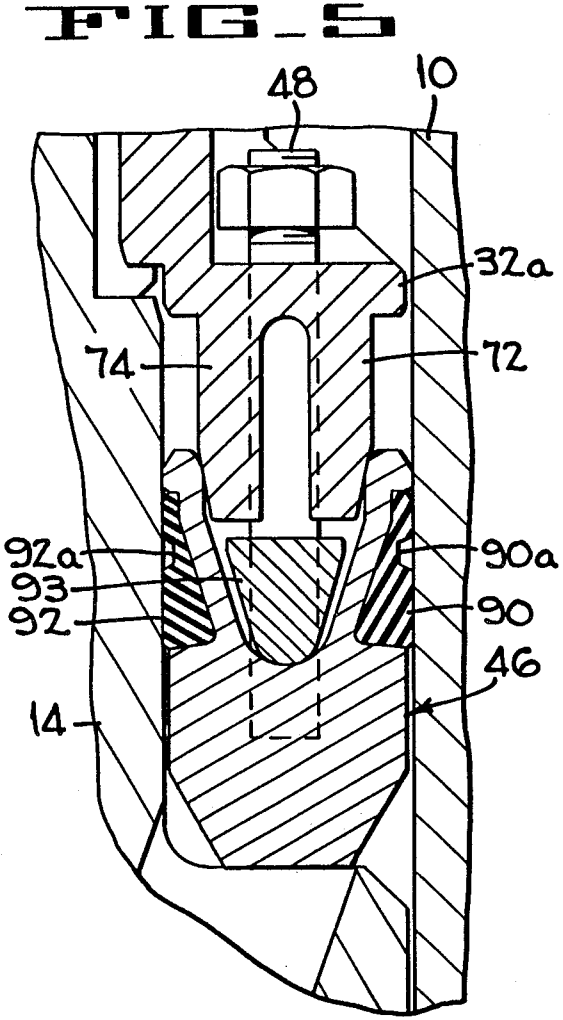

FIG. 5 illustrates a modification of the packoff seal of FIG. 1–4, wherein annular elastomeric seals 90, 92 with annular surface grooves 90*a*, 92*a* are employed with the metal seal element 46 in place of the elastomeric seals 56, 58 and the anti-extrusion rings 60, 62. Also, the spacers 93 of this embodiment do not include a central web as present in the preferred embodiment.

Figure 6:
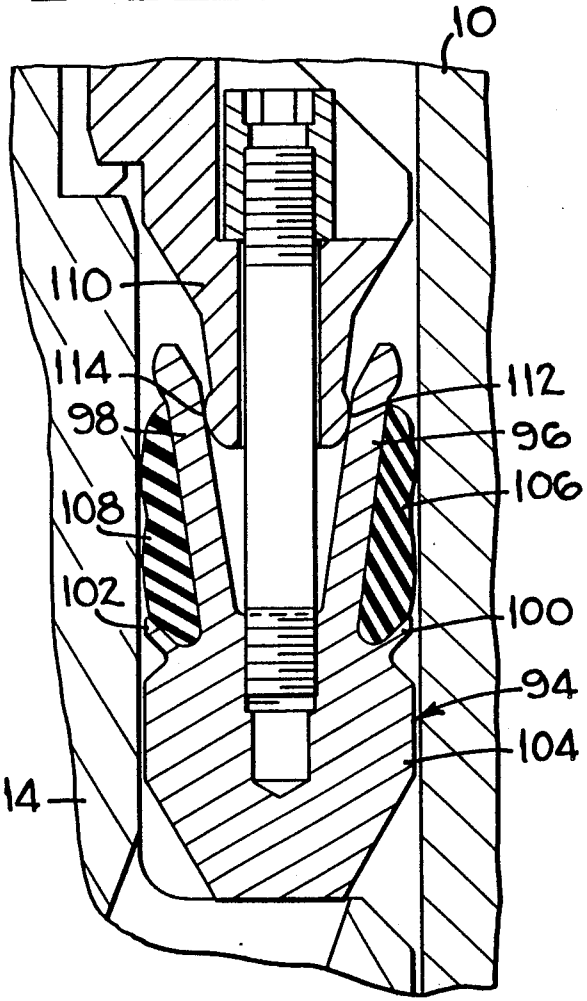

FIG. 6 illustrates another metal seal element 94 with sealing lips 96, 98 of slightly different configuration than the corresponding lips 52, 54 of the FIGS. 1–4 embodiment. This metal seal element 94 also includes a pair of relatively small annular ribs 100, 102 that project upwardly and outwardly from the seal element base 104, and annular elastomeric seals 106, 108 of an undulate surface configuration that reside between the lips and the ribs. In this embodiment, the lower outer surfaces of the seal energizer portion 110 of the packoff lower body have radiused surfaces 112, 114 that bear against the inside surfaces of the legs 96, 98.

Figure 7:
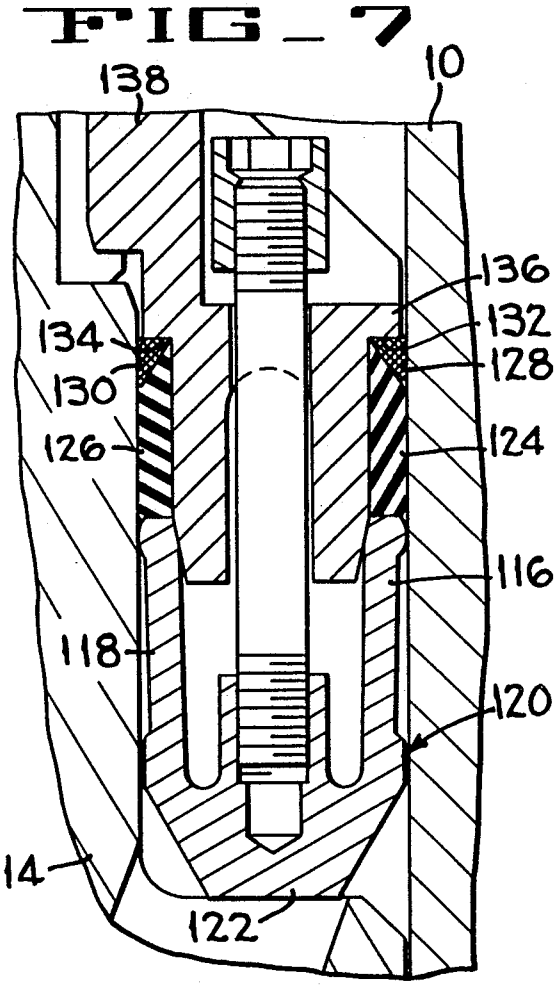
FIGS. 5–7 are enlarged fragmentary views in vertical section illustrating additional embodiments of the metal seal element of a packoff assembly according to this invention.

In the FIG. 7 embodiment the sealing lips 116, 118 of the uniquely shaped metal seal element 120 extend from near the outer edges of the elements base 122, and annular elastomeric seals 124, 126 with annular anti-extrusion rings 128, 130 are held captive between the ends of the lips and opposed shoulders 132, 134 on the seal energizer portion 136 of the packoff's lower body 138.

Even though the above described embodiments of FIGS. 5–7 differ in geometry from the preferred embodiment of FIGS. 1–4, it should be understood that the several corresponding parts and surfaces of these further embodiments provide the same functions in response to the same energization as that of the preferred embodiment.

We claim:

1. An annular packoff for establishing a higher pressure metal barrier between adjacent surfaces of concentric tubular elements, said packoff comprising an assembly including:

(a) a two-piece annular body having an upper component rotatably interconnected to a lower component for relative axial movement of the components in opposite directions;

(b) a lock ring surrounding said upper component and expandable therefrom;

(c) an annular lock ring expander mandrel surrounding said upper component above said lock ring, said mandrel having means to expand said lock ring response to an axial force exerted thereon;

(d) anti-rotation means releasably secured to said lower component for preventing undesired relative rotation of said upper and lower components;

(e) Annular metal seal means secured to said lower component for establishing a metal-to-metal seal between said concentric tubular elements, said seal means comprising an annular metal base having a pair of annular metal sealing lips extending upwardly therefrom; and (f) Energizer means extending from said lower component into operational position between said lips, said energizer means comprising a pair of annular legs for wedging said lips apart into pressure tight contact with said tubular element surfaces in response to an axial force exerted thereon, said legs acquiring bending energy during said wedging movement and applying said energy to said lips to maintain said pressure tight metal-to-metal contact thereof with said surfaces over extreme fluctuations in pressure to which said seal means is exposed.

2. A packoff according to claim 1 including spacer means between said annular legs to prevent said legs from deforming beyond acceptable limits in response to wedging pressure exerted thereon.

3. A packoff according to claim 1 including elastomeric seal means located on said metal seal means to provide a secondary sealing function.

4. A packoff according to claim 1 wherein the sealing lips diverge from the base and also provide a retaining function for annular non-metallic secondary seal means.

5. An annular seal assembly for establishing a metal pressure barrier between adjacent surfaces of concentric tubular elements, said assembly comprising:

(a) annular metal seal means for establishing a metal-to-metal seal between said concentric tubular elements, said seal means comprising an annular metal base having a pair of annular metal sealing lips extending axially therefrom; and (b) energizer means in operational position between said lips, said energizer means comprising an annular rigid base and a pair of annular legs extending axially from said rigid base towards the seal means base in the direction opposite that of the sealing lips extension from said seal means base for wedging said lips apart into pressure tight contact with said tubular element surfaces in response to an axial force exerted thereon, said legs acquiring bending energy to said lips to maintain said pressure tight metal-to-metal contact thereof with said surfaces over extreme fluctuations in pressure to which said seal means is exposed.

6. A seal assembly according to claim 5 including elastomeric seal means located on said metal seal means to provide a second sealing function.

7. A seal assembly according to claim 5 wherein the sealing lips diverge from the base and also provide a retaining function for annular non-metallic secondary seal means.

8. An annular seal assembly for establishing a metal pressure barrier between adjacent surfaces of concentric tubular elements, said assembly comprising:

(a) annular metal seal means for establishing a metal-to-metal seal between said concentric tubular elements, said seal means comprising an annular metal base having a pair of annular metal sealing lips extending axially therefrom;

(b) energizer means extending into operational position between said lips, said energizer means comprising a pair of annular legs for wedging said lips apart into pressure tight contact with said tubular element surfaces in response to an axial force exerted thereon, said legs acquiring bending energy during said wedging movement and applying said energy to said lips to maintain said pressure tight metal-to-metal contact thereof with said surfaces over extreme fluctuations in pressure to which said seal means is exposed; and (c) spacer means between said annular legs to prevent said legs from deforming beyond acceptable limits in response to wedging pressure exerted thereon.

* * * * *